US006176212B1

(12) United States Patent
Vilou

(10) Patent No.: US 6,176,212 B1
(45) Date of Patent: Jan. 23, 2001

(54) METHOD AND DEVICE FOR CONTROLLING ENERGIZATION OF THE COIL OF A MOTOR VEHICLE STARTER CONTACTOR

(75) Inventor: Gérard Vilou, Tassin (FR)

(73) Assignee: Valeo Equipements Electriques Moteur, Creteil (FR)

( * ) Notice: Under 35 U.S.C. 154(b), the term of this patent shall be extended for 0 days.

(21) Appl. No.: 09/204,836

(22) Filed: Dec. 3, 1998

(30) Foreign Application Priority Data

Dec. 3, 1997 (FR) ..... 97 15222

(51) Int. Cl.[7] ..... F02N 11/08
(52) U.S. Cl. ..... 123/179.3; 290/38 R; 361/154
(58) Field of Search ..... 123/179.3, 179.25; 290/38 R, 38 C; 361/154

(56) References Cited

U.S. PATENT DOCUMENTS 5,197,326 * 3/1993 Palm ..... 73/118.1
5,383,428 * 1/1995 Fasola et al. ..... 123/179.3
5,622,148 * 4/1997 Xue et al. ..... 123/179.25
5,831,804 * 11/1998 Vilou ..... 123/179.3

FOREIGN PATENT DOCUMENTS 40 26 232 * 2/1992 (DE) .
43 44 355 * 7/1994 (DE) .
0 796 992 * 9/1997 (EP) .

* cited by examiner

*Primary Examiner*—Andrew M. Dolinar
(74) *Attorney, Agent, or Firm*—Morgan & Finnegan, L.L.P.

(57) ABSTRACT

In a method of controlling energisation of the coil of a motor vehicle starter contactor the coil is energised in a pick-up mode to close the contactor and then in a latching mode to hold the contactor closed. A voltage corresponding to the supply voltage of the electric motor of the starter is measured, a drop in this voltage corresponding to the closing of the contactor is detected, and the coil of the contactor is energised in latching mode after a predetermined time-delay from detection of the voltage drop.

18 Claims, 2 Drawing Sheets

METHOD AND DEVICE FOR CONTROLLING ENERGIZATION OF THE COIL OF A MOTOR VEHICLE STARTER CONTACTOR

FIELD OF THE INVENTION

The present invention relates to a method and device for controlling energisation of the coil of a motor vehicle starter contactor.

BACKGROUND OF THE INVENTION

FIG. 1 of the accompanying drawings shows a standard starter circuit diagram.

The electrical starter motor M is connected between ground and a terminal +Bat at the battery supply voltage.

Energisation of the motor M is controlled by a contactor C which is a relay comprising a power contact 3 controlled by a latching coil 1 and a pick-up coil 2.

The power contact 3 is disposed between the motor M and the supply terminal at the voltage +Bat, for example.

A common end of the pick-up and latching coils 1 and 2 is connected to the +Bat supply terminal, for example via a starter switch 4 which is generally an ignition switch. The opposite end of the latching coil 1 is connected to ground and the pick-up coil 2 is connected to a point between the contact 3 and the motor M.

When the ignition switch 4 closes, the two coils 1 and 2 are energised simultaneously and their magnetic forces of attraction on the mobile core of the contactor add together. The attraction forces are sufficient to overcome the return springs and the friction on the contactor and on the starter. At the end of its travel the closing of the power contact 3 applies substantially the same potential to both ends of the pick-up coil 2, which prevents any current flowing through it. Only the latching coil 1 remains energised. However, because of the very small air gap that remains at this time, the forces generated by the holding coil 1 remain higher than the return forces of the various springs, which means that the contactor C can remain closed. This economises the current consumed by the pick-up coil 2 and prevents it overheating.

Electronic control of the contactor enables the use of only one coil. This is shown by the circuit represented in FIG. 2, in which the power contact 3 of the contactor C is moved by an energisation coil B connected between ground and the supply terminal +Bat at the battery voltage. Energisation of the coil B is controlled by a control unit U which operates a switch S. The control unit U is generally a microprocessor one input e of which is connected to the +Bat terminal via the starter switch 4, for example, and an output s of which controls the switch S, which is a MOSFET, for example.

When the switch 4 closes the microprocessor U carries out a number of operations to assure that the starter is ready to be actuated, whereupon the transistor S is commanded by a pulse width modulation (PWM) signal to generate at the coil B a predetermined voltage law to assure forward movement of the mobile core at low speed.

FIG. 3*a* shows a sequence of closing the starter switch 4 and FIG. 3*b* shows one example of the evolution in time of the average energisation current Ic flowing in the coil B during the closing sequence. FIG. 3*c* shows the closing sequence of the power contact 3 that corresponds to this energisation.

Throughout a first period T following the closing of the switch 4 the current Ic is maintained at a sufficiently high pick-up level to guarantee that the power contact 3 is closed.

The period T is made sufficiently long for the contacts to close in all operating configurations: battery type, battery charge state, starter type, starting temperature, etc.

At the end of this first period the PWM control function of the microprocessor U reduces the current in the coil B to a minimal value im which holds the magnetic circuit closed.

The reader will already have understood that the uncertain nature of the time actually required to close the power contact 3 imposes an overgenerous time T for the change to latching mode.

However, in most cases the power contact 3 has closed well before the end of the period T (between the times that correspond to the points A and B shown in FIG. 3*b*).

This causes unnecessary overheating of the power transistor 3 throughout the portion of the period T in which the power contact 3 is closed, i.e. throughout the period D shown in FIG. 3*c*.

DISCUSSION OF THE INVENTION

One object of the invention is therefore to solve the above problem.

DE 43 44 355 has already proposed to control energisation of a contactor coil by connecting the coil to a latching power supply as soon as closing of the contactor is detected.

The invention proposes to control energisation in a way that minimises heating of the coil whilst assuring highly reliable closing.

To this end, the invention proposes a method of controlling energisation of the coil of a motor vehicle starter contactor in which the coil is energised in a pick-up mode adapted to close the contactor and then in a latching mode adapted to hold the contactor closed, wherein a voltage corresponding to the supply voltage of the electric motor of the starter is measured, a drop in this voltage corresponding to the closing of the contactor is detected, and the coil of the contactor is energised in latching mode after a predetermined time-delay from detection of the voltage drop.

For preference, the voltage corresponding to the supply voltage of the electric motor of the starter is sampled and, to detect the voltage drop, the difference between two successive voltage measurements is compared to a threshold.

The threshold advantageously corresponds to a voltage drop in the order of 1 volt.

In another aspect, the invention provides a device for controlling energisation of a vehicle starter electric motor, including a contactor comprising a relay having a power contact and a coil, and a control unit adapted to command successive energisation of the coil in a pick-up mode adapted to close the contactor and then in a latching mode adapted to hold the contactor closed, the control unit measuring a voltage which, when starting is commanded, corresponds to the supply voltage of the electric motor of the starter and commanding energisation of the electric motor in accordance in particular of this voltage, characterised in that the control unit includes means for implementing the above method.

Energisation of the coil is advantageously controlled by a MOSFET, a gate of which is controlled by a pulse width modulated voltage generated by the control unit.

The control unit preferably includes means for turning on the transistor when the coil is energised in pick-up mode.

The invention also concerns a motor vehicle starter including a control device of the above kind.

Other features and advantages of the invention will become apparent in the following description which is illustrative and non-limiting and which is to be read in conjunction with the accompanying drawings.

DESCRIPTION OF A PREFERRED EMBODIMENT OF THE INVENTION

Figure 1:
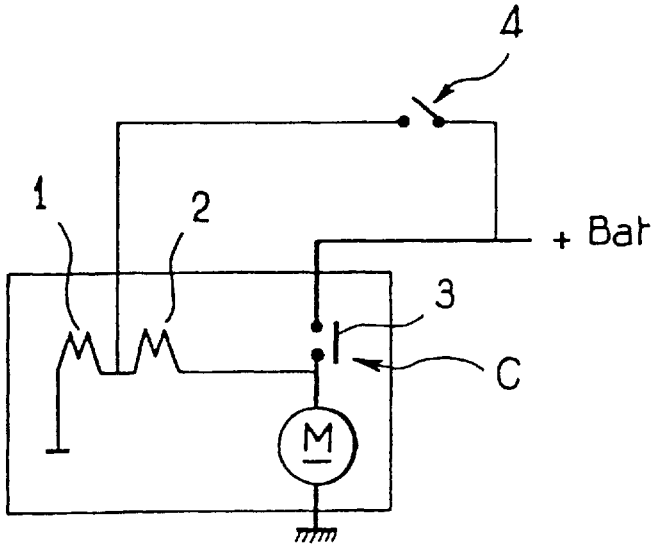
FIG. 1, already analysed, shows a prior art starter circuit.
Figure 2:
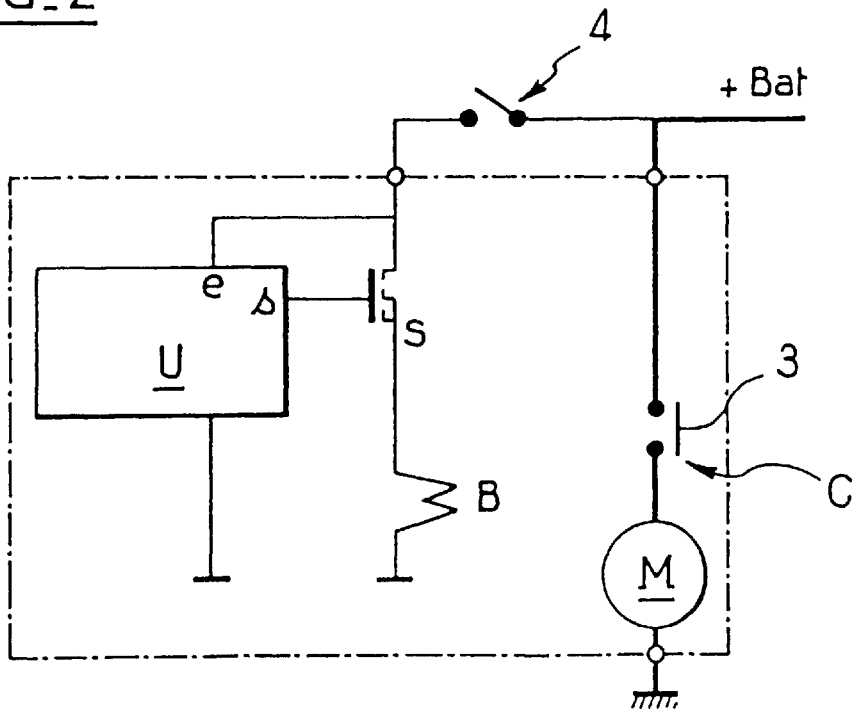
Prior Art FIG 2
FIG. 2, also discussed already, shows a starter electronic control circuit where the contactor includes a single pick-up and latching coil.
Figure 3:
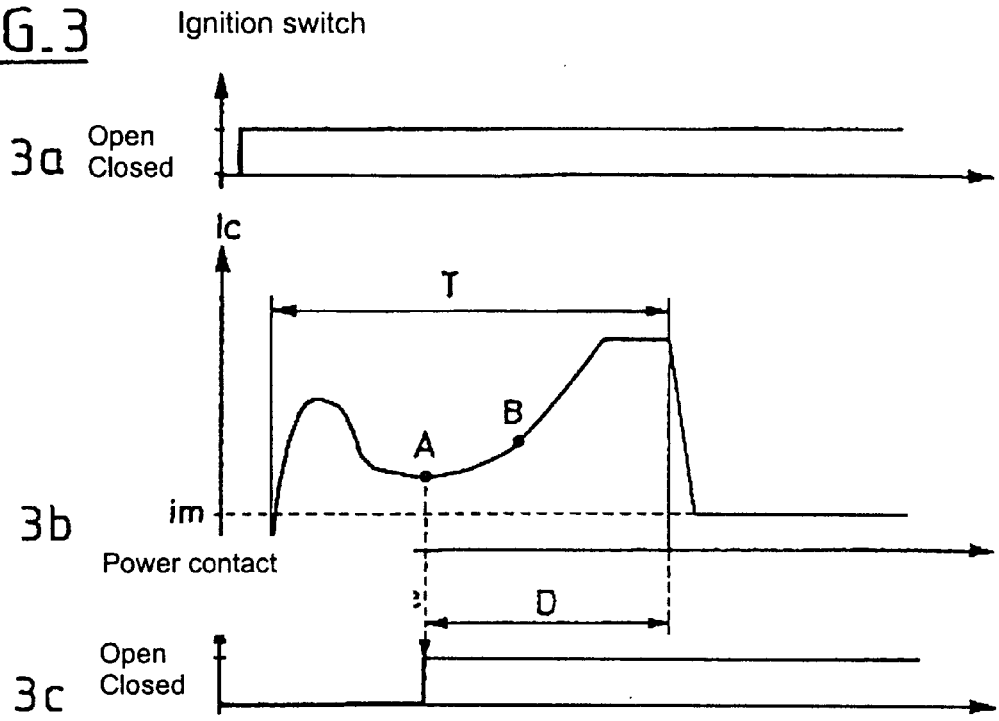
FIGS. 3*a* through 3*c* show one possible sequence for energising the single coil of the contactor in the FIG. 2 circuit.
Figure 4:
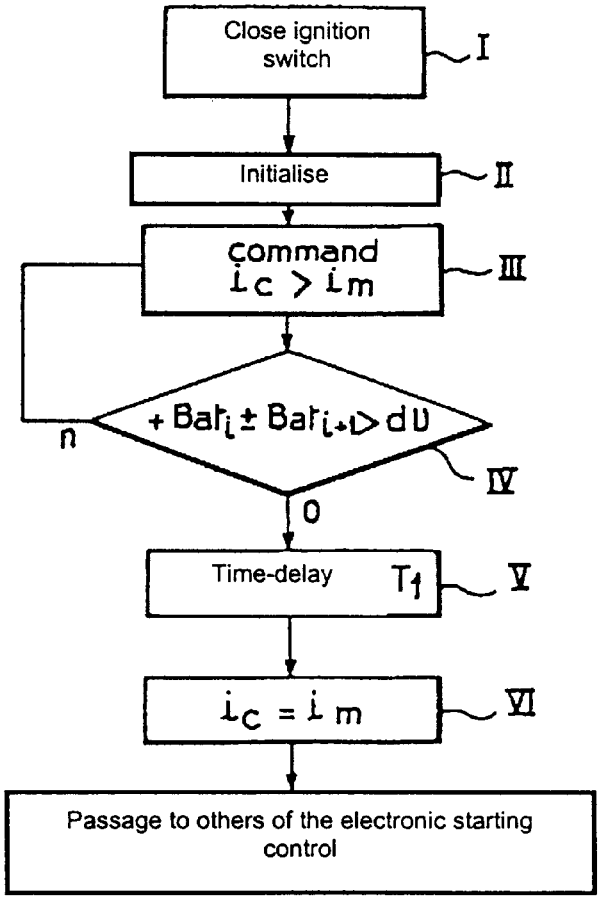
FIG. 4 is a flowchart showing how the energisation of the single coil of the contactor in the FIG. 2 circuit is controlled.

The control sequence shown in FIG. 4 is executed by the means for controlling energisation of the single coil B shown in FIG. 2, i.e. by the switch S and the control unit U, the latter being programmed to control the transistor S in accordance with the control sequence that will now be described.

When the starter switch 4 closes (step I in FIG. 4), the control unit U is powered up and initialised (step II).

The voltage +Bat that it receives at its input e is sampled and converted to a digital value. The digital values of the voltage +Bat obtained in this way are processed by the unit U, said unit U generating at its output s a PWM voltage for controlling the gate of the transistor S which is dependent in particular on these values of the voltage +Bat.

In particular, the unit U compares the difference ($+Bat_i - +Bat_{i+1}$) between two successive voltage measurements $+Bat_i$ and $+Bat_{i+1}$ (where i is a mute index associated with the successive samples) to a given threshold dU (test IV).

If the difference is below said threshold, the transistor S is commanded to make the current Ic greater than im (step III). The coil B can then be at the full voltage, for example, the control unit U turning the transistor S fully on.

When the difference is above said threshold, the unit U changes the duty cycle of its PWM output voltage to command the transistor S so that the current in the coil B is maintained at its value im (step VI) after a time-delay T1 (step V). The value of im is sufficient to keep the magnetic circuit closed.

The value of dU is chosen so that the voltage drop produced by the closing of the contact 3 can be detected.

It is known that when the power contact 3 closes there is a very high inrush current after the electric motor M is energised.

There follows a sudden voltage drop (characteristic of the closing of the contact), generally by an amount in the range 1 volt to 5 volts, i.e. much greater than the voltage drops generated by the current drawn by the contactor C.

The value of the threshold dU is chosen to correspond to 1 volt, for example.

Note that the time-delay T1 between detection of the closing of the contact 3 and the change to latching mode avoids rebound phenomena and assures that the contactor is effectively closed on entering latching mode.

As the reader will have understood, a control scheme of the above kind minimises heating of the coil B and of the power transistor S without requiring any additional internal or external electrical connection for the starter.

What is claimed is:

1. A method of controlling energization of a coil of a motor vehicle starter contactor comprising the steps of energizing the coil in a pick-up mode closing said contactor, and energizing said coil in a latching mode holding said contactor closed, a voltage corresponding to the supply voltage of the electric motor of the starter being measured, a drop in this voltage corresponding to the closing of said contactor being detected, and said coil of said contactor being energized in latching mode after a predetermined time-delay from detection of said voltage drop.

2. The method claimed in claim 1 further comprising the steps of sampling the voltage corresponding to the supply voltage of said electric motor of said starter and detecting said voltage drop by comparing the difference between two successive voltage measurements to a threshold value.

3. The method claimed in claim 2 wherein said threshold value corresponds to a voltage drop of the order of 1 volt.

4. A device for controlling energization of a vehicle starter electric motor, including a contactor, comprising a relay having a power contact and a coil, and a control unit adapted to command successive energization of said coil in a pick-up mode adapted to close the contactor and then in a latching mode adapted to hold said contactor closed, said control unit measuring a voltage which corresponds to the supply voltage of said electric motor of said starter when starting is commanded, said control unit commanding energization of said electric motor, in accordance with said voltage, and said control unit commanding energization of said coil in said latching mode after a predetermined time from when said voltage which corresponds to the supply voltage drops by a threshold value.

5. The device claimed in claim 4 wherein energization of said coil is controlled by a MOSFET, a gate of which is controlled by a pulse width modulated voltage generated by said control unit.

6. The device claimed in claim 5 wherein said control unit includes means for turning on said transistor when said coil is energized in pick-up mode.

7. A motor vehicle starter including the device as claimed in claim 4.

8. A device for controlling energization of a vehicle starter motor comprising:

a relay having a power contact and a coil, and a control unit configured to command successive energization of the coil in a pick-up mode to close the power contact and in a latching mode to hold the power contact closed, the control unit having a means for detecting a change in a supply voltage corresponding to the closing of the power contact, wherein said control unit commands energization of the coil in a latching mode after a predetermined time-delay when the change in the voltage exceeds a predetermined threshold voltage.

9. The device according to claim 8 further comprising a switch operated by the control unit to control energization of the coil.

10. The device according to claim 9 wherein the switch is a MOSFET whose gate is controlled by a pulse width modulated voltage generated by the control unit.

11. The device according to claim 8 wherein the predetermined threshold voltage is in the range of 1 to 5 volts.

12. The device according to claim 8 wherein the predetermined threshold voltage is approximately 1 volt.

13. The device according to claim 8 wherein the predetermined time-delay is configured to avoid rebound phenomena and to assure that the contactor is effectively closed on entering latching mode.

14. A method of controlling energization of a coil of a vehicle starter electric motor contactor comprising the steps of:

measuring a voltage corresponding to a supply voltage of the electric motor of the starter;

energizing the coil in a pick-up mode closing said contactor;

detecting a drop in the voltage exceeding a predetermined threshold voltage corresponding to the closing of the contactor; and energizing the coil in a latching mode holding said contactor closed after a predetermined time-delay.

15. The method of claim 14, wherein the step of detecting a drop in the voltage comprises the steps of sampling the voltage corresponding to the supply voltage of the electric motor of the starter and comparing the difference between two successive voltage measurements to the predetermined threshold voltage.

16. The method according to claim 14 wherein the predetermined threshold voltage is in the range of 1 to 5 volts.

17. The method according to claim 14 wherein the predetermined threshold voltage is approximately 1 volt.

18. The method according to claim 14 wherein the predetermined time-delay is configured to avoid rebound phenomena and to assure that the contactor is effectively closed on entering latching mode.

* * * * *